US005797777A

United States Patent [19]

Tsunekawa et al.

[11] Patent Number: 5,797,777

[45] Date of Patent: Aug. 25, 1998

[54] OUTBOARD MOTOR CONTROL

[75] Inventors: Hiroyuki Tsunekawa; Kouji Abe, both of Hamamatsu, Japan

[73] Assignee: Sanshin Kogyo Kabushiki Kaisha, Hamamatsu, Japan

[21] Appl. No.: 948,506

[22] Filed: Oct. 10, 1997

Related U.S. Application Data

[63] Continuation of Ser. No. 492,710, Jun. 20, 1995, abandoned.

[30] Foreign Application Priority Data

Jun. 22, 1994 [JP] Japan ..... 6-163261

[51] Int. Cl.[6] ..... B60K 41/00

[52] U.S. Cl. ..... 440/84; 440/86; 440/87

[58] Field of Search ..... 440/52, 49, 53, 440/61, 63, 84, 85, 86, 87; 74/480 B

[56] References Cited

U.S. PATENT DOCUMENTS 4,582,493 4/1986 Toyohara et al. ..... 440/84

5,180,320 1/1993 Calamia et al. ..... 440/53

OTHER PUBLICATIONS

M&E Marine Supply Company Catalog, Camden NJ, p. 190 Oct. 1988.

*Primary Examiner*—Stephen Avila

*Attorney, Agent, or Firm*—Knobbe, Martens, Olson & Bear LLP

[57] ABSTRACT

A control handle for the tiller of an outboard motor that embodies a twist-grip throttle control, a pivotally supported transmission control and a trim switch, all juxtaposed to each other but oriented in such a way so that actuation of one will not affect accidental actuation of any other control. The trim control is disposed in a projection on the lower side of the outer housing of the control handle and is disposed inwardly from the sides thereof and is protected by a flange.

13 Claims, 7 Drawing Sheets

OUTBOARD MOTOR CONTROL

CROSS REFERENCE TO RELATED APPLICATIONS

This application is a continuation of U.S. patent application Ser. No. 08/492,710, filed Jun. 20, 1995 now abandoned.

BACKGROUND OF THE INVENTION

This invention relates to an outboard motor control and more particularly to a control for attachment to the tiller of an outboard motor for controlling a variety of functions, including speed and trim condition.

With outboard motors and particularly those of smaller displacements and horsepower, it is the normal practice to provide a steering handle that is attached pivotally to the tiller and which may be employed by an operator for controlling the operation of the watercraft and particularly the powering outboard motor from a position adjacent the transom. In addition to providing the steering function, it is a normal practice to mount a twist-grip throttle on this steering handle by which the operator may control the speed of the engine of the outboard motor. In addition, it is frequently the practice to provide a shift lever which is also mounted on the steering handle and which controls the transmission of the outboard motor. Of course, it is necessary to provide in the steering handle motion transmitting mechanisms for transferring the rotary motion of the twist-grip throttle and the pivotal motion of the shift lever into back and forth or reciprocating motion. This reciprocating motion is transmitted by flexible transmitters to the engine speed and outboard motor transmission controls. Obviously, this requires the provision of a fairly compact assembly.

Frequently, it is also proposed to provide another control, such as a trim switch control, which is also mounted on this steering handle assembly. Thus, at least three different controls may be mounted on the same steering handle assembly. They must all be positioned in proximity to each other so that they can be operated by a single hand. However, the controls also should be arranged in such a way that operation of one will not accidentally cause unwanted operation of another control. With previously proposed constructions this has been difficult.

It is a principle object of this invention to provide an improved and simplified trim control for an outboard motor.

It is a further object of this invention to provide an improved control handle assembly for an outboard motor wherein a plurality of controls may be provided, motion transmitting mechanisms can be incorporated for transmitting motion of these controls into the appropriate motion of the controlled element, and wherein the elements are positioned so that they cannot be accidentally operated.

SUMMARY OF THE INVENTION

This invention is adapted to be embodied in a control handle assembly for the tiller of an outboard motor and which comprises an outer housing for attachment to the tiller for steering of the outboard motor. A throttle control is rotatable about an axis defined by the outer housing for connection to an engine speed control element for controlling the speed of the outboard motor. A control switch for controlling another function is disposed on the outer housing below the throttle control axis and inwardly of the outer periphery of the outer housing so as to avoid its accidental operation.

DETAILED DESCRIPTION OF THE PREFERRED EMBODIMENT OF THE INVENTION

Figure 1:
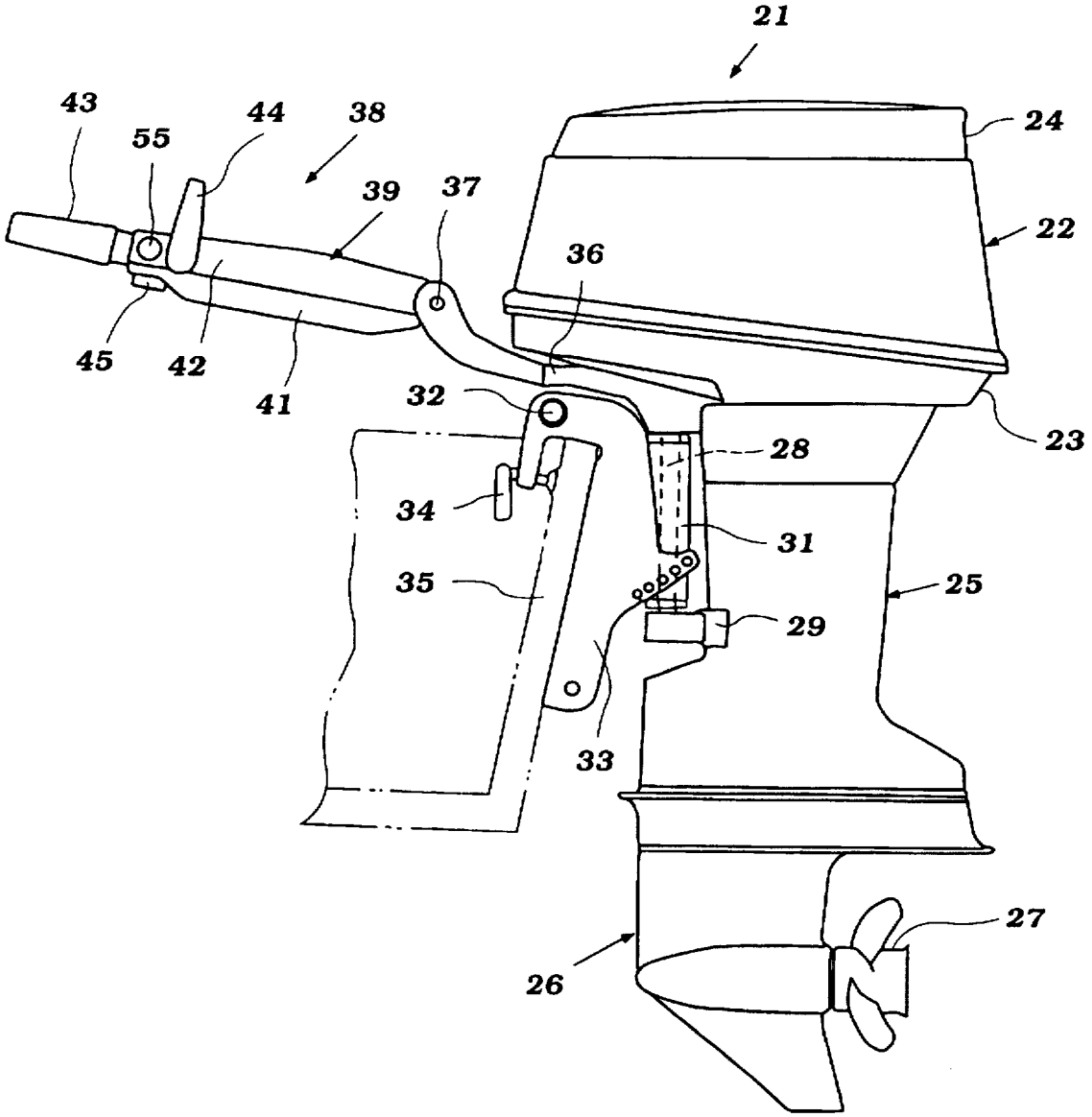
FIG. 1 is a side elevational view of an outboard motor constructed in accordance with an embodiment of the invention and as attached to the transom of an associated watercraft, shown partially and in phantom.
Figure 2:
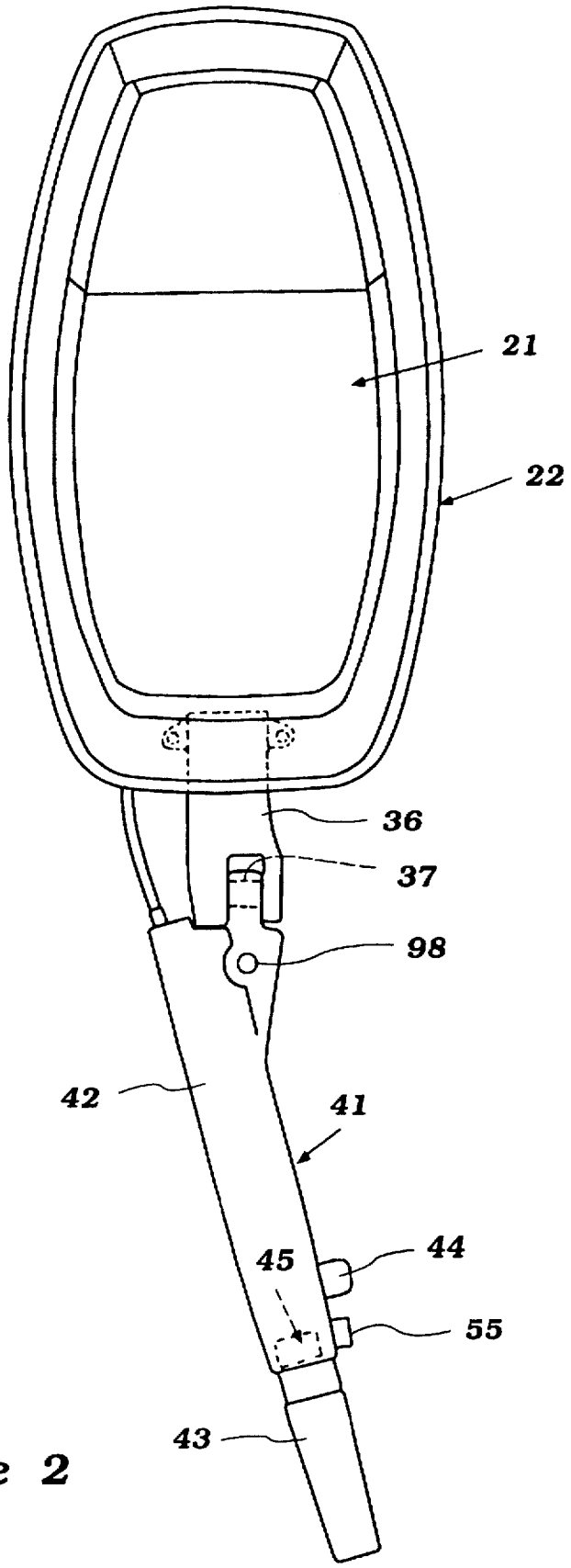
FIG. 2 is an enlarged top plan view of the outboard motor.

Referring now in detail to the drawings and initially to FIGS. 1 and 2, an outboard motor constructed in accordance with an embodiment of the invention is identified generally by the reference numeral 21. The outboard motor 21 is comprised of a power head assembly, indicated generally by the reference numeral 22, which includes a powering internal combustion engine (not shown) that is surrounded by a protective cowling. The cowling is comprised of a lower tray portion 23 and an upper main cowling portion 24 that is detachably connected to the tray portion 23 in any known manner. The engine of the power head may be of any known type, but is provided with a speed control which may comprise either a throttle valve, a fuel injection control valve, or the like.

As is typical with outboard motor practice, the powering internal combustion engine of the power head 22 is supported so that its output shaft rotates about a vertically extending axis. This output shaft is vertically positioned so as to facilitate coupling to a drive shaft (not shown) that rotates about a vertically disposed axis and is journaled in a drive shaft housing, indicated generally by the reference numeral 25. The drive shaft housing 25 depends from the power head 22. The drive shaft continues on into a lower unit, indicated generally by the reference numeral 26, where it drives a propeller 27 through a forward/neutral/reverse transmission (not shown) which may be of any known type. This transmission is provided with a dog clutching element or other shifting arrangement for shifting between neutral, forward drive, and reverse drive conditions, as is well known in this art. This transmission is operated in a manner to be described.

A steering shaft 28 is affixed to the drive shaft housing 25 by means including an upper bracket assembly (not shown) and a lower bracket assembly 29. The steering shaft 28 is journaled for steering movement of the outboard motor 21 about a vertically disposed steering axis within a swivel bracket 31.

The swivel bracket 31 is, in turn, connected by means of a pivot pin 32 to a clamping bracket 33 for tilt and trim movement of the outboard motor 21 about a horizontally disposed axis. The clamping bracket 33 carries a clamping device 34 for detachable connection to the transom 35 of an associated watercraft, as shown in phantom.

A tiller 36 is affixed in a known manner to the steering shaft 28 and extends forwardly beneath the power head 22. An upstanding portion of the tiller 36 carries a pivot pin 37 upon which a control handle assembly, indicated generally by the reference numeral 38 and constructed in accordance with an embodiment of the invention, is pivotally connected. The construction of the outboard motor 21 as thus far described may be considered to be conventional, and for that reason a further description of it is not believed to be necessary to permit those skilled in the art to practice the invention. Also, those skilled in the art will readily understand how the invention can be utilized with any of a wide variety of types of conventional outboard motors.

The control handle assembly 38 will now be described in more detail by primary reference to the remaining figures. However, before dealing directly with those figures, a general overall description of the control handle assembly will be made by continued reference to FIGS. 1 and 2.

The control handle assembly 38 includes an outer housing assembly 39 which is made up primarily of a lower piece 41 and an upper piece 42 that is detachably connected to the lower piece. The housing pieces 41 and 42 may be formed from a suitable material such as an aluminum alloy casting or the like.

A twist-grip throttle control 43 is mounted on the forward end of the control handle outer housing 39 for rotation about a longitudinally extending axis. The twist-grip throttle control 43 is connected to the speedcontrolling element of the engine of the outboard motor 21 in a manner which will be described.

Pivotally supported on one side of the housing assembly 39 is a shift lever 44. The shift lever 44 is connected, in a manner which will also be described, to the transmission as aforenoted for effecting its shifting, in a manner which will also be described.

Finally, there is provided on the underside of the outer housing 39, between the throttle grip 43 and the transmission shift control 44, a trim control switch 45. The trim control switch 45 is operative to control a reversible electric motor or the like which drives a hydraulic pump which, in turn, operates a hydraulic cylinder that is interposed between the swivel bracket and the clamping bracket 33 for adjusting the trim and tilt position of the outboard motor 21. Such trim cylinders and their operating hydraulic systems are well known in the art. Since the invention does not deal with the trim cylinder or its associated hydraulic system but rather the way in which it is controlled, a further description of the trim cylinder and its hydraulic circuit is not believed to be necessary to permit those skilled in the art to practice the invention.

Referring now to the construction of the control handle assembly 38 by principal reference to FIGS. 3–7, as has been noted, it is comprised primarily of an outer housing assembly 39 that consists of a lower piece 41 and an upper piece 42. These pieces are held, as previously noted, together in any suitable manner, and they define an internal cavity in which certain mechanisms, now to be described, are contained.

The upper housing piece 42 has a forwardly extending pilot section 46 on which the twist-grip throttle control 43 is rotatably journaled in any known manner. A throttle control shaft 47 is coupled by means of a pin 48 to the twist-grip throttle control 43 and is journaled in a first bearing block 49 at the forward end of the housing assembly 39 and a second bearing block 51 positioned rearwardly therein.

Figure 4:
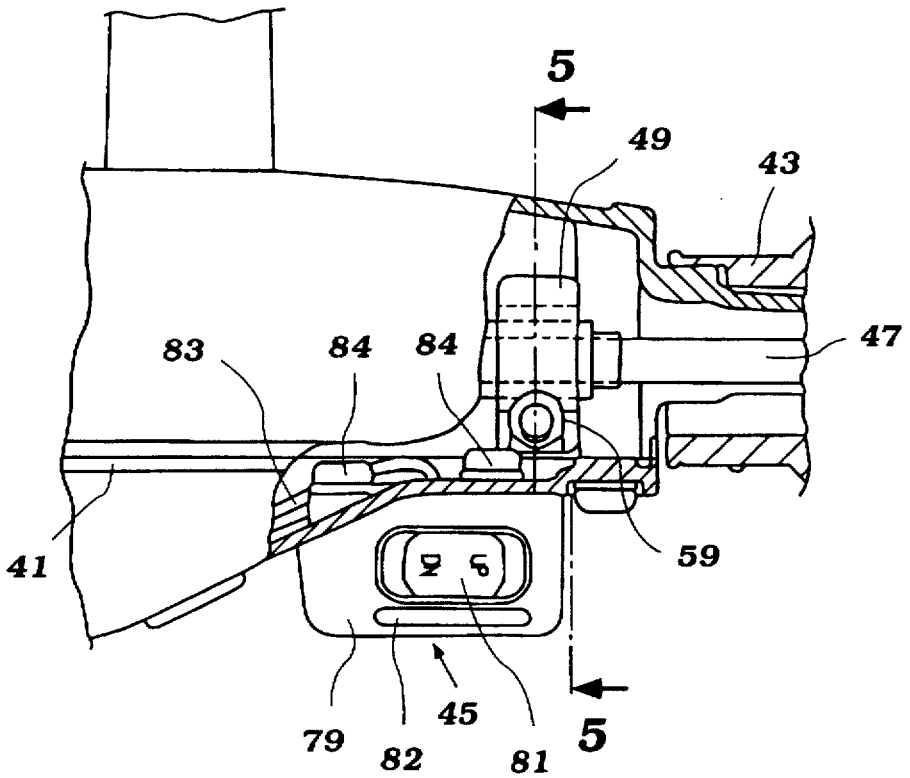
FIG. 4 is a further enlarged side elevational view looking in the same direction as FIGS. 1 and 3 and with a portion broken away.
Figure 5:
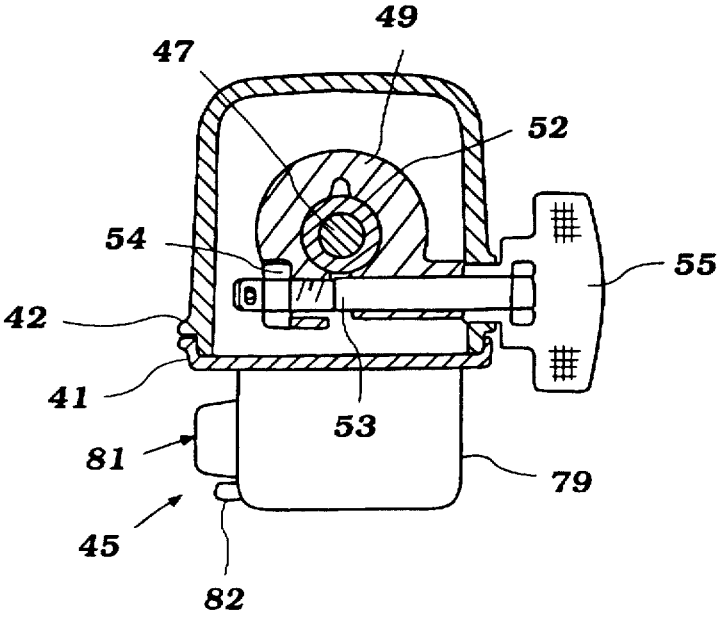
FIG. 5 is a cross-sectional view taken along the line 5—5 of FIG. 4 and shows the throttle grip lock.

The first bearing block 49 is provided, as best shown in FIGS. 4 and 5, as a split housing assembly that contains a nylon bushing 52 or the like. A clamping shaft 53 has a threaded connection with a nut 54 and carries a knob 55 at its outer end. By rotating the knob 55, pressure is applied on the split clamp 49 to place a drag on rotation of the throttle control shaft 47 in the twist-grip throttle control 43. The operator may, if he desires, adjust the knob 55 so as to assist in restraining the throttle condition for the engine at a predetermined throttle setting, for example, when trolling or under other conditions.

A bevel gear 56 is fixed to the throttle shaft 47 on the rear side of the rear bearing 51. This bevel gear is meshed with a further bevel gear 57 that is fixed to an idler shaft 58 which is, in turn, journaled or fixed in the interior of the outer housing 39.

Affixed to the beveled gear 57 is a lever arm 59 which has a connection as at 61 to a throttle wire actuator 62. The throttle wire actuator 62 is received within a protective sheath 63 which is retained by a rear bracket assembly 64, in a manner to be described. This throttle wire actuator 62 and its protective sheath 63 extends rearwardly through an opening 65 formed in the rear of the housing assembly 39 and through a sealing elastic grommet 66. As has been previously noted, this wire actuator 62 is connected to the engine speed control in any manner known in this art.

The shift control lever 44 is affixed to a shift shaft 67 which is, in turn, journaled suitably within the housing piece 39 and which rotates about an axis that extends transversely to the axis of the throttle control shaft 47, but which is offset to one side of it. A detent cam arrangement 68 is affixed to the shift shaft 67 and is connected by means of a pivot pin 69 to one end of a link 71. The other end of the link 71 is connected by a pivot pin 72 to a bell crank 73. The bell crank 73 is, in turn, pivotally supported in the housing assembly 39 on a pivot shaft 74.

The end of the bell crank 73 remote from the pivot connection 72 is connected by a connector 75 to a transmission wire actuator 76. This wire actuator 76 is contained within a protective sheath 77 and extends rearwardly to the bracket 64 where it is retained in a manner which will also be described later. This protective sheath 77 and the contained transmission wire actuator 76 extends also through the opening 65 and grommet 66 for connection to the transmission control in any known manner. A detent ball to cooperate with the cam 68 to releasably retain it and the associated transmission control elements in the forward, neutral and reverse positions.

The throttle control mechanism and shift control mechanism operated by the twist-grip throttle control 43 and lever shift control 44 may contain an interlock mechanism, as shown in our copending application, Ser. No. 08/304,097, entitled "Control for Outboard Motor," filed Sept. 9, 1994, and assigned to the assignee hereof. Since the invention in this application deals primarily with the orientation of the controls and protection of them, further description of the actual mechanism for providing the throttle and transmission control is not believed to be necessary to understand the construction and operation of the embodiment of the invention. Reference may be had to our copending application for a description of this mechanism. Alternatively, other mechanisms of known types may be employed.

Referring now to the trim control 45, it will be noted that the lower housing piece 41 has, at its forward end, an upwardly extending sloped part 78 which is formed forwardly of the area where the shift lever 44 is connected and immediately to the rear of the twist-grip throttle control 43. The housing piece 41 is formed with a protrusion 79 that extends into this area and which defines an interior cavity in which a three-way switch having a switching operator 81 is positioned. The switching operator 81 extends through an opening or window 82 formed in the projection 79 so that it can be easily actuated. However, as best seen in FIG. 4, this switching operator 81 is disposed inwardly of the outer periphery of the housing assembly 39, and hence cannot be accidentally actuated. In addition, a protecting flange 82 extends outwardly from the housing projection 79 and below the switching operator 81 so as to further protect it without interfering with its accessibility.

The switch having the switching operator 81 controls electrical conductors 83 that are contained within the interior of the housing assembly 39 and which extend rearwardly and exit through the opening 65 and grommet 66 for connection to the appropriate electric motor and controls therefor, as aforenoted. As may be best seen in FIG. 4, the switch having the actuator 81 is affixed to the housing assembly by means of screws 84.

Figure 3:
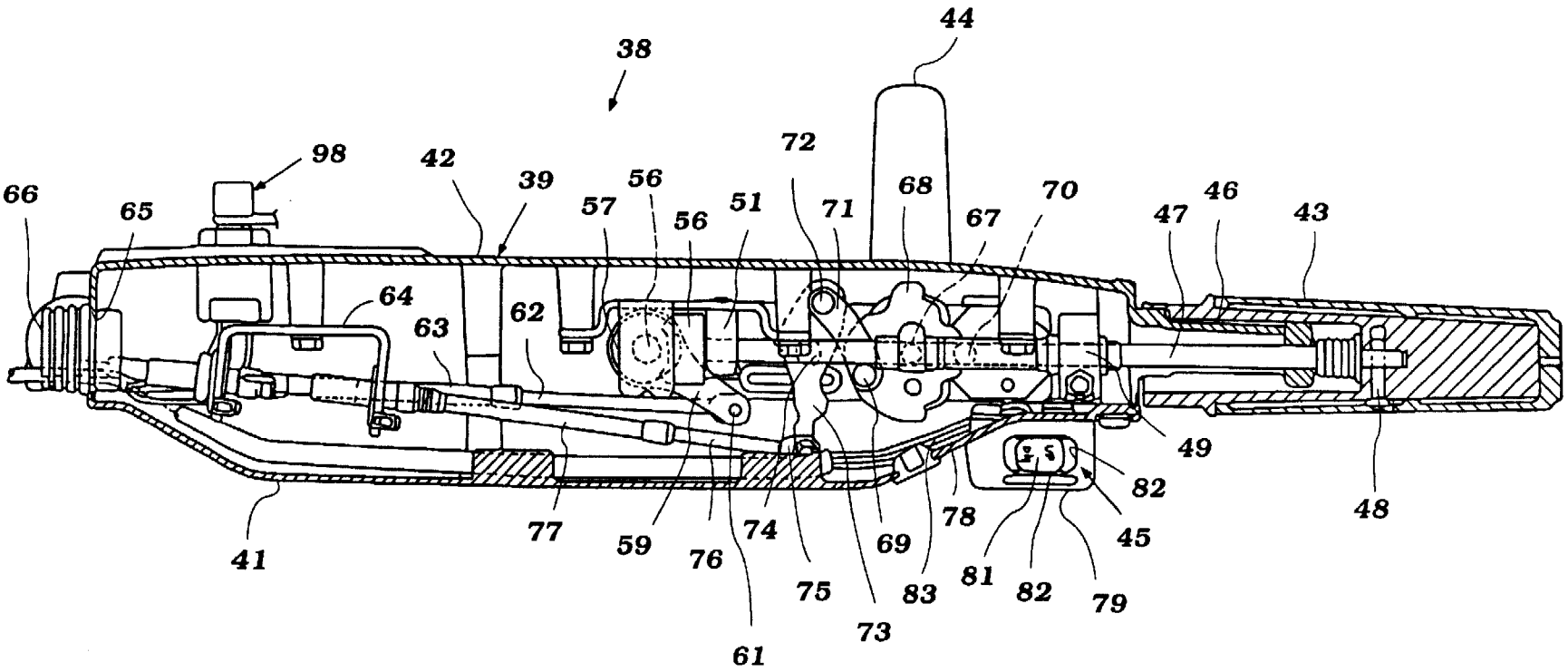
FIG. 3 is a still further enlarged longitudinal cross-sectional view taken through the control handle assembly.
Figure 6:
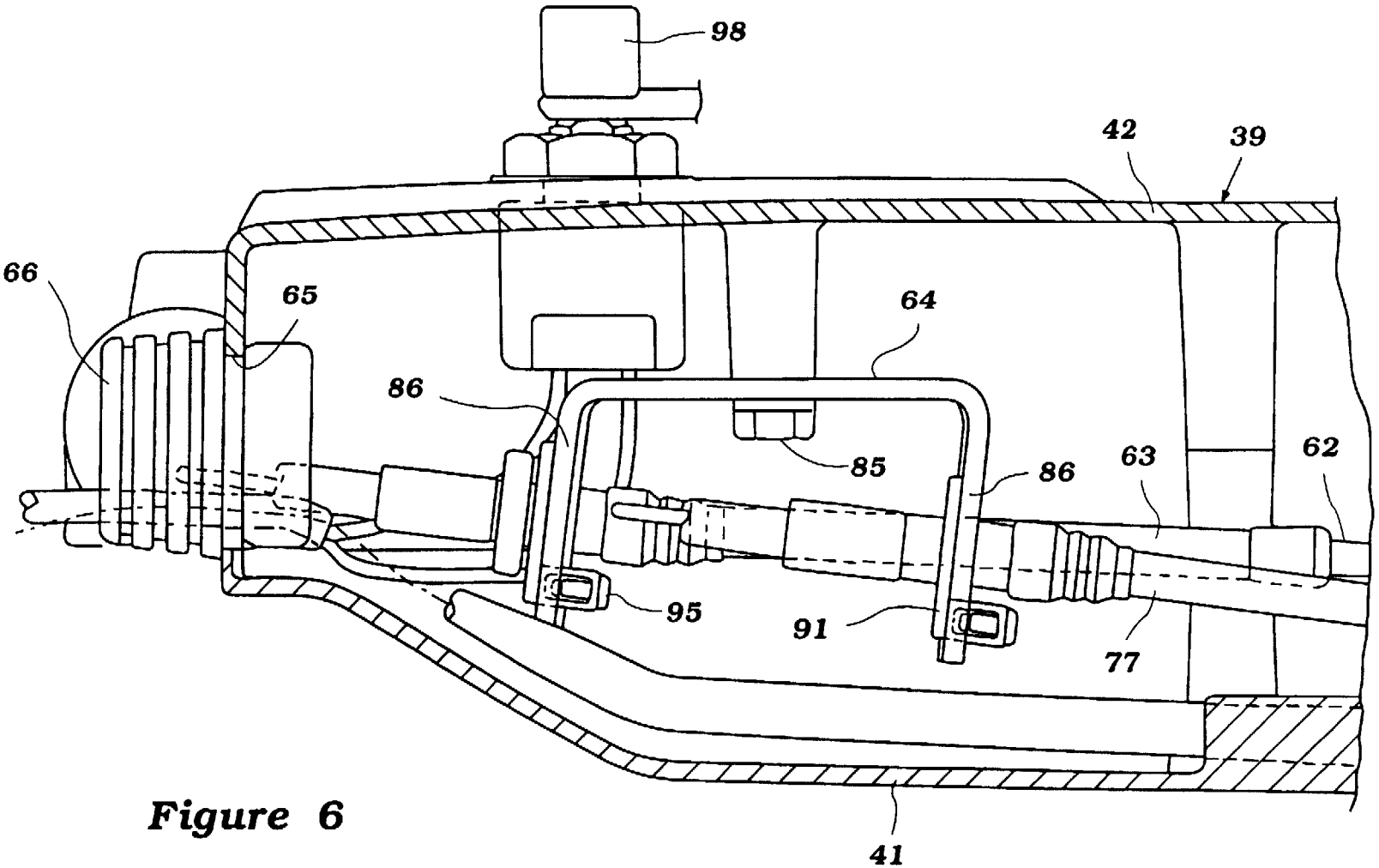
FIG. 6 is an enlarged cross-sectional view taken along the same plane as FIG. 3 and shows the construction at the rear portion of the control handle assembly.
Figure 7:
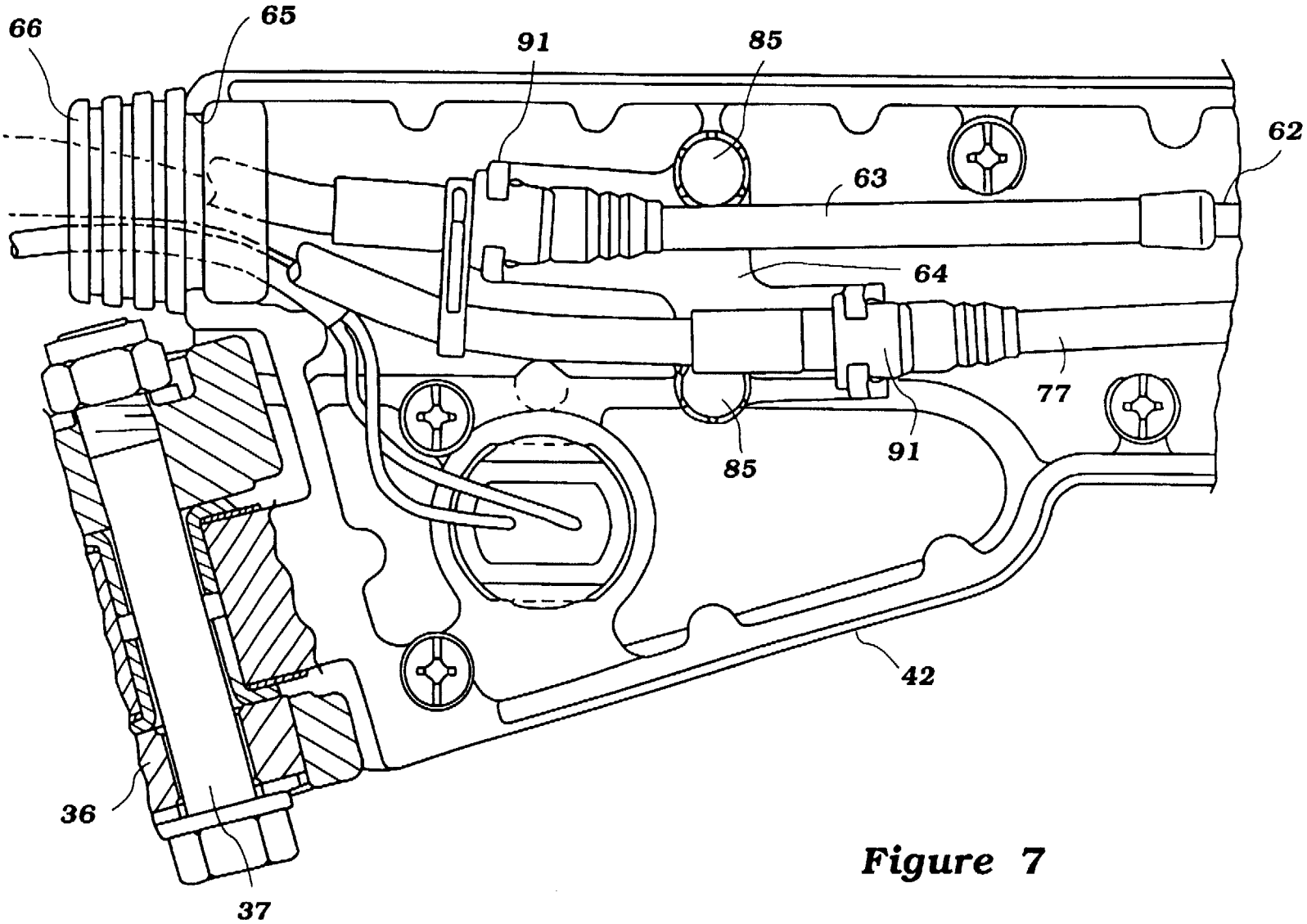
FIG. 7 is a cross-sectional view of the same portion of the control handle assembly shown in FIG. 6 but taken along a plane perpendicular to the plane of FIG. 6.
Figure 8:
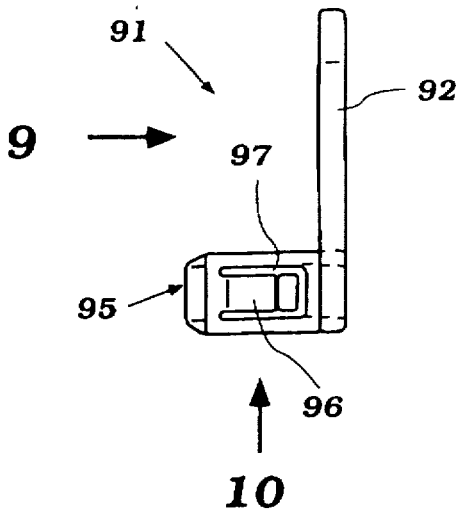
FIG. 8 is an enlarged side elevational view of a retainer clip constructed in accordance with an embodiment of the invention.
Figure 9:
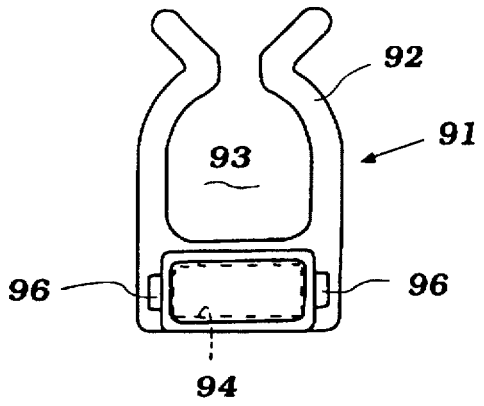
FIG. 9 is an enlarged rear elevational view of the retainer clip, looking in the direction of the arrow 9 in FIG. 8.
Figure 10:
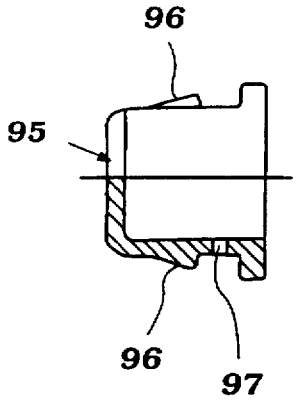
FIG. 10 is a bottom view taken in the direction of the arrow 10 in FIG. 8, with a portion broken away and shown in section.
Figure 11:
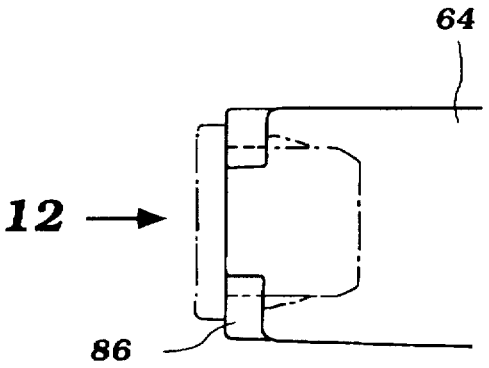
FIG. 11 is a top plan view of a portion of the wire actuator retainer bracket.
Figure 12:
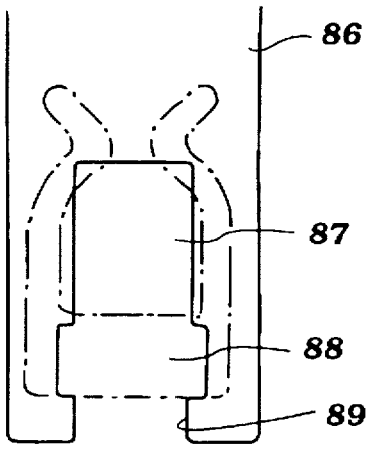
FIG. 12 is an elevational view looking in the direction of the arrow 12 in FIG. 11.

As has been noted, the wire actuators 62 and 76 and the electrical conductors 83 extend rearwardly through the opening 65 and through the grommet 66 in the area best shown in FIGS. 3, 6, and 7. A retaining bracket 64, previously referred to, is affixed to the housing piece 42 in this area by threaded fasteners 85. This retaining bracket 64 has a pair of downwardly extending flanges 86, each of which is formed with an opening, as best seen in FIG. 11. Each opening has an upper rectangular portion 87 and a lower rectangular portion 88 with a slot 89 formed at the bottom thereof. The portion 87 passes the wire actuators, and specifically their protective sheaths 63 and 77, and receives a retaining clip, indicated generally by the reference numeral 91, and having a construction best shown in FIGS. 7–9. This retaining clip 91 includes a pair of upwardly extending leg portions 92 which defines an opening 93 that is complementary to the opening 87 and through which the protective sheaths 63 and 77 extend. This retaining clip 91 further includes a generally rectangular opening 94 which is aligned with the flange openings 88 and which receive a retainer element, indicated generally by the reference numeral 95 and which have a pair of locking lugs 96 so as to trap the retainer member 95 in position and also so as to attach the retainer 91 to the bracket 64 in a manner which is believed to be apparent. A slotted opening 97 is formed around the retainer lugs 96 so as to add to their flexibility and to permit ease of assembly and disassembly and positive locking in place.

In addition to the controls as thus far described, there may be also provided on the control handle assembly 38 a kill switch, indicated generally by the reference numeral 98. This kill switch 98 is connected to the ignition circuit for the engine of the outboard motor so as to permit it to be disabled to stop the engine in a manner well known in this art.

Thus, from the foregoing description it should be readily apparent that the described arrangement provides a very compact and highly effective control for an outboard motor that accommodates a trim switch and which places the trim switch in a location so that it can be easily activated, but wherein it also will not be inadvertently operated.

Of course, the foregoing description is that of a preferred embodiment of the invention, and various changes and modifications may be made without departing from the spirit and scope of the invention, as defined by the appended claims.

We claim:

1. A control handle for the tiller of an outboard motor comprising an elongated outer housing for attachment at its rear end to the tiller for steering of the outboard motor and extending forwardly therefrom, a throttle control extending forwardly from said outer housing and rotatable about an axis defined by said outer housing for connection to an engine speed control element for controlling the speed of said outboard motor, a transmission control supported for movement by said outer housing at the front thereof and in juxtaposition to said throttle control and associated with a transmission control of said outboard motor for operating it, said transmission control being mounted on one exterior surface of said outer housing, and a control switch carried at the front of said outer housing for controlling another function disposed on an other outer surface of said outer housing and inwardly of the outer periphery of and surrounded by said other surface of said outer housing to avoid inadvertent activation thereof while still permitting selective activation thereof.

2. The control handle for the tiller of an outboard motor of claim 1, wherein the control switch is juxtaposed to the rear end of the throttle control.

3. The control handle for the tiller of an outboard motor of claim 2, wherein the transmission control is rotatably supported about an axis that extends transversely to the throttle control axis.

4. The control handle for the tiller of an outboard motor of claim 3, wherein the control switch is disposed on the side of the outer housing opposite to the transmission control.

5. The control handle for the tiller of an outboard motor of claim 3, wherein the outer housing is comprised of an upper housing portion and a lower housing portion detachably connected to each other and defining an interior cavity containing motion transmitting means for transmitting rotary motion of the throttle control and pivotal motion of the transmission control into reciprocating motion of wire actuators connected to the throttle control and transmission control of the outboard motor.

6. The control handle for the tiller of an outboard motor of claim 5, wherein the outer housing is formed with a projection on its lower surface that is disposed inwardly of the outer sides of the outer housing and which defines an opening facing on the opposite direction from the transmission control and through which a control switch actuating portion extends.

7. The control handle for the tiller of an outboard motor of claim 6, wherein the outer housing projection defines a projecting flange portion extending beneath the control switch actuating portion.

8. The control handle for the tiller of an outboard motor of claim 2, wherein the control switch operates a trim control system for the outboard motor.

9. The control handle for the tiller of an outboard motor of claim 8, wherein the transmission control is rotatably supported about an axis that extends transversely to the throttle control axis.

10. The control handle for the tiller of an outboard motor of claim 9, wherein the control switch is disposed on the side of the outer housing opposite to the transmission control.

11. The control handle for the tiller of an outboard motor of claim 9, wherein the outer housing is comprised of an upper housing portion and a lower housing portion detachably connected to each other and defining an interior cavity containing motion transmitting means for transmitting rotary motion of the throttle control and pivotal motion of the transmission control into reciprocating motion of wire actuators connected to the throttle control and transmission control of the outboard motor.

12. The control handle for the tiller of an outboard motor of claim 11, wherein the outer housing is formed with a projection on its lower surface that is disposed inwardly of the outer sides of the outer housing and which defines an opening facing on the opposite direction from the transmission control and through which a control switch actuating portion extends.

13. The control handle for the tiller of an outboard motor of claim 12, wherein the outer housing projection defines a projecting flange portion extending beneath the control switch actuating portion.

* * * * *